US007407157B2

(12) United States Patent
Hansson et al.

(10) Patent No.: US 7,407,157 B2
(45) Date of Patent: Aug. 5, 2008

(54) ARRANGEMENT FOR HANDLING BANKNOTES AND/OR OTHER DOCUMENTS

(75) Inventors: Gustaf Lars-Åke Hansson, Mellösa (SE); Kurt Erik Skånberg, Katrineholm (SE)

(73) Assignee: Gunnebo Safe Pay AB, Gothenburg (SE)

( * ) Notice: Subject to any disclaimer, the term of this patent is extended or adjusted under 35 U.S.C. 154(b) by 450 days.

(21) Appl. No.: 10/526,188

(22) PCT Filed: Sep. 2, 2003

(86) PCT No.: PCT/SE03/01359

§ 371 (c)(1),
(2), (4) Date: Mar. 2, 2005

(87) PCT Pub. No.: WO2004/032068

PCT Pub. Date: Apr. 15, 2004

(65) Prior Publication Data

US 2005/0242499 A1 Nov. 3, 2005

(30) Foreign Application Priority Data

Sep. 2, 2002 (SE) ..... 0202586

(51) Int. Cl.
*B65H 3/44* (2006.01)

(52) U.S. Cl. ..... 271/9.08; 271/163; 271/293

(58) Field of Classification Search ..... 271/163, 271/9.08, 293, 294, 295
See application file for complete search history.

(56) References Cited

U.S. PATENT DOCUMENTS

| | | | | |
|---|---|---|---|---|
| 3,096,089 | A * | 7/1963 | Swenker et al. | 271/293 |
| 3,930,581 | A | 1/1976 | Gray | |
| 4,145,038 | A * | 3/1979 | Mol | 270/58.21 |
| 4,678,179 | A * | 7/1987 | Edwards et al. | 271/295 |
| 4,729,554 | A * | 3/1988 | Honegger | 270/52.3 |
| 5,556,087 | A * | 9/1996 | Gosslinghoff | 270/58.18 |
| 6,213,310 | B1 | 4/2001 | Wennersten et al. | |
| 6,354,590 | B1 * | 3/2002 | Payne | 271/295 |

FOREIGN PATENT DOCUMENTS

| | | |
|---|---|---|
| EP | 0 604 880 A2 | 7/1994 |
| EP | 0 783 162 A1 | 7/1997 |
| SE | 508 152 C2 | 9/1998 |

* cited by examiner

*Primary Examiner*—David H Bollinger
(74) *Attorney, Agent, or Firm*—Browdy and Neimark

(57) ABSTRACT

An arrangement for handling banknotes includes a magazine (13) containing a plurality of magazine pockets (18). Each pocket (18) has an infeed and outfeed opening (26) through which a banknote can be fed in into or fed out from the pocket (18). Furthermore, each pocket is provided with elements (27) for releasably holding a banknote fed in into the pocket (18) within the same. The arrangement also includes controllable driving members (16, 17), that allow a selectable magazine pocket (18) to be placed with its opening (26) in front of an infeed and/or outfeed station (14, 15) located adjacent to the magazine (13), and feeding members (33) for controllably feeding in a banknote into or feeding out a banknote from a pocket (18) placed in front of the station (14, 15). The feeding members consist of feeding members (33) provided at the station (14, 15).

7 Claims, 6 Drawing Sheets

ARRANGEMENT FOR HANDLING BANKNOTES AND/OR OTHER DOCUMENTS

Figure 1:
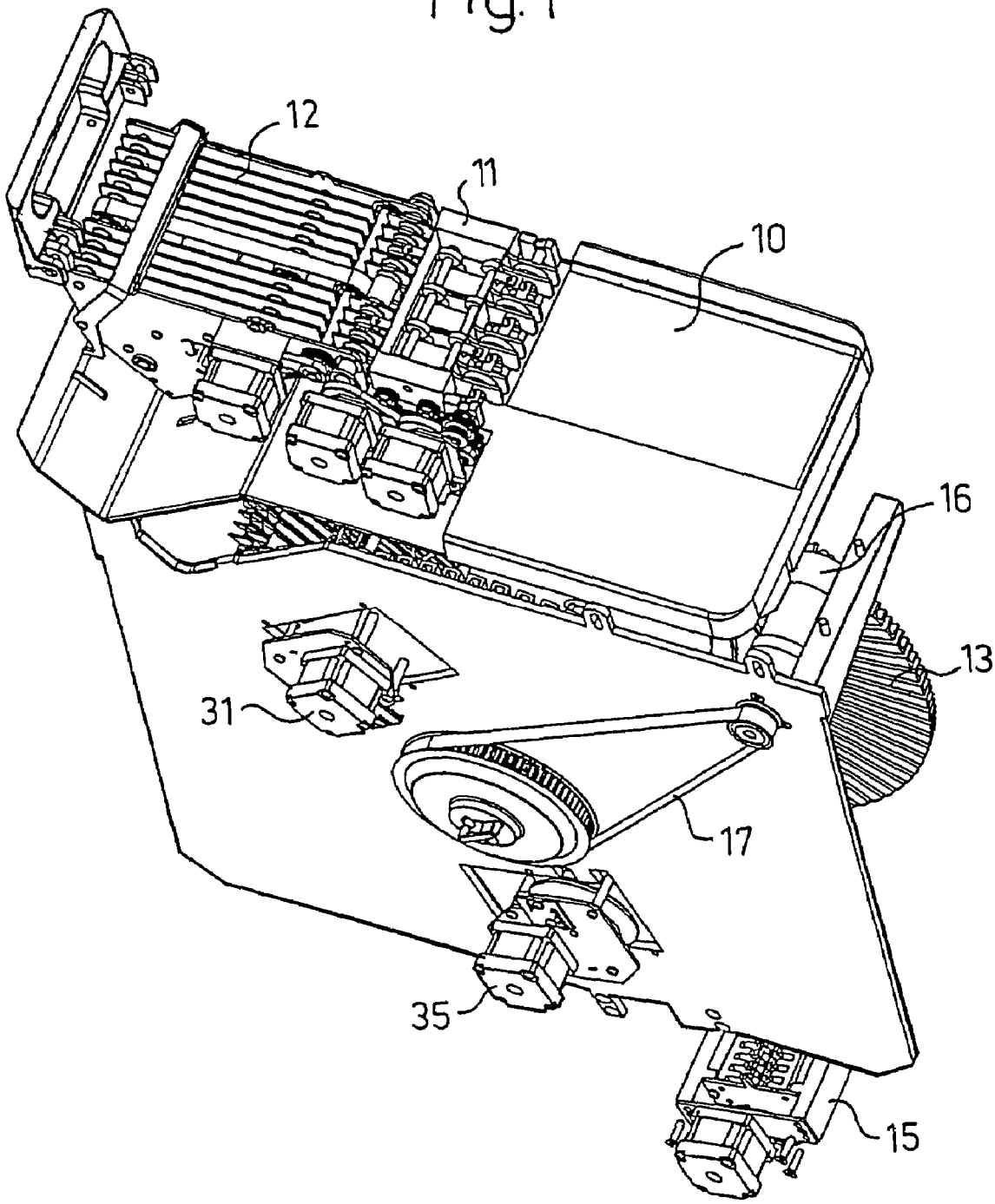

The present invention relates to an arrangement for handling banknotes and/or other documents.

More particularly, the invention relates to such an arrangement of the kind comprising a magazine containing a plurality of magazine pockets, each one of said pockets being arranged to receive only one banknote or other document therein and having, at one end thereof, a combined infeed and outfeed opening through which a banknote or other document can be fed in into or fed out from the pocket, and each one of said pockets being provided with means for releasably holding a banknote or other document fed in into the pocket within the same, said arrangement also comprising a controllable driving means for the magazine, by means of which a selectable magazine pocket can be placed with its said opening in front of at least one infeed and/or outfeed station located adjacent to the magazine, and feeding means for controllably feeding in a banknote or other document into or controllably feeding out a banknote or other document from a pocket placed in front of said station.

An arrangement of said kind, especially intended for handling banknotes at cash desks or the like is previously known through SE-C2 508 152. However, in practice, this known arrangement presents manifest disadvantages. Firstly, it has been found that the movement of a selected pocket of the magazine to a position in front of an infeed and/or outfeed station cannot be effected at a sufficient speed to permit a plurality of banknotes to be fed in into or fed out from the magazine at a very rapid pace. Secondly, it has also been found that, the possible number of pockets in the magazine is far too limited to meet the requirements nowadays existing in respect of the total number of banknotes that the magazine should be able to contain.

The invention has for its purpose to provide an improved arrangement of the kind initially specified wherein the above disadvantages can be eliminated.

The arrangement according to the invention proposed for said purpose is primarily characterized in that said feeding means consist of feeding means provided at said station.

The invention makes it possible in a favourable manner to avoid the substantial restrictions in respect of the possible rate of feeding in banknotes into or feeding out banknotes from the magazine as well as in respect of the possible number of pockets in the magazine that exist in the known arrangement and are caused by the fact that the feeding means are formed by separate feeding means provided at each individual magazine pocket and giving rise to a high total moment of inertia of the magazine and additionally resulting in that the pockets will inevitably have a comparatively high thickness at their ends provided with said openings. The proposed use of feeding means provided at the infeed and/or outfeed station instead of separate feeding means at each individual pocket makes it possible for given total dimensions of the magazine to obtain a considerable reduction of the total moment of inertia of the magazine while simultaneously reducing the thickness of the magazine pockets and hence substantially increasing the number of magazine pockets. Moreover, the invention also results in a considerable reduction of the manufacturing costs for each individual magazine pocket as well as for the arrangement as a whole.

The feeding means may preferably comprise at least one pair of controllably rotatable cylinders or rollers provided at said station and arranged to bear against mutually opposite sides of a banknote or other document inserted therebetween.

Furthermore, said holding means of each pocket may suitably comprise at least one pair of resiliently flexible clamping means having clamping portions located at or near said opening and movable relatively to each other between, on the one hand clamping positions, in which they are arranged to bear resiliently against mutually opposite sides of a banknote or other document fed in into the pocket, and, on the other hand, release positions, in which they permit an unobstructed infeed of a banknote or other document into or an unobstructed outfeed of a banknote or other document from the pocket by means of said feeding means.

According to a preferred embodiment of the invention, the arrangement may comprise cam means provided at said station and the clamping portions of a magazine pocket placed in front of the station may be capable of being brought to engage said cam means and move from their clamping positions to their release positions through a limited relative displacement of said pocket and said cam means in direction towards each other.

In this case, said cam means may be mounted in stationary positions, whereas each magazine pocket is movably mounted in the magazine for controllable limited movement thereof between, on the one hand a retracted inner end position, and on the other hand an outer end position, in which it protrudes from the rest of the magazine and to which it can move temporarily when it is placed in front of said station.

Alternatively, said cam means may however instead be mounted for limited movement thereof in direction towards the magazine, whereas the magazine pockets are stationary mounted in the magazine.

The magazine may preferably consist of a rotatable magazine drum containing a plurality of sector-like magazine pockets.

According to a favourable embodiment of the invention, the arrangement may comprise a sensor which, when a banknote or other document is fed in into a magazine pocket placed in front of an infeed station and having its clamping portions located in their release positions due to an engagement with said cam means, is arranged to sense when the rear end of said banknote or other document reaches a predetermined position and then trigger a relative movement of said pocket and said cam means in a direction away from each other and simultaneously adapt the speed at which the feeding means tend to feed said banknote or other document to the speed of said relative movement of said pocket and said cam means in direction away from each other.

Figure 2:
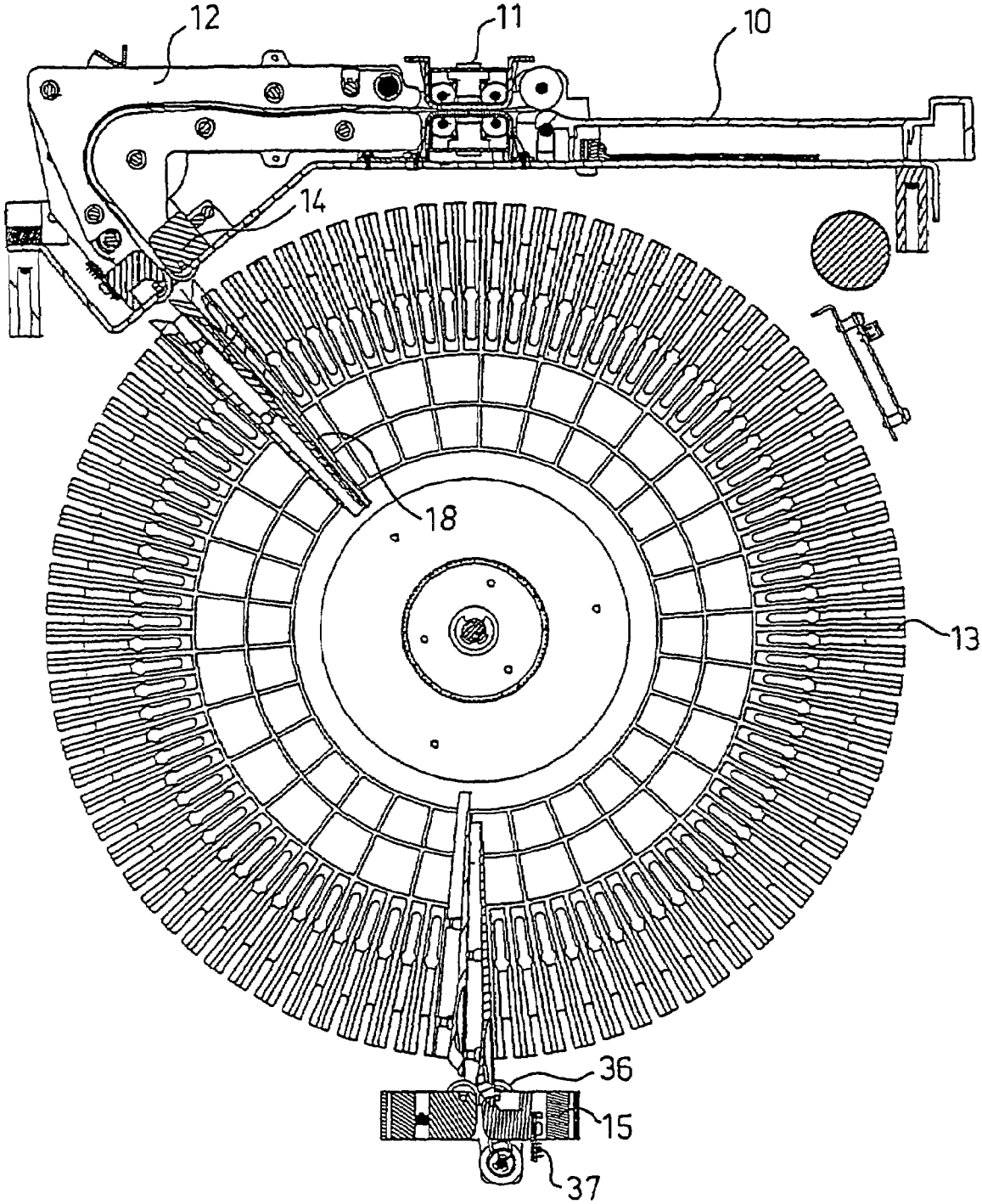
Figure 3:
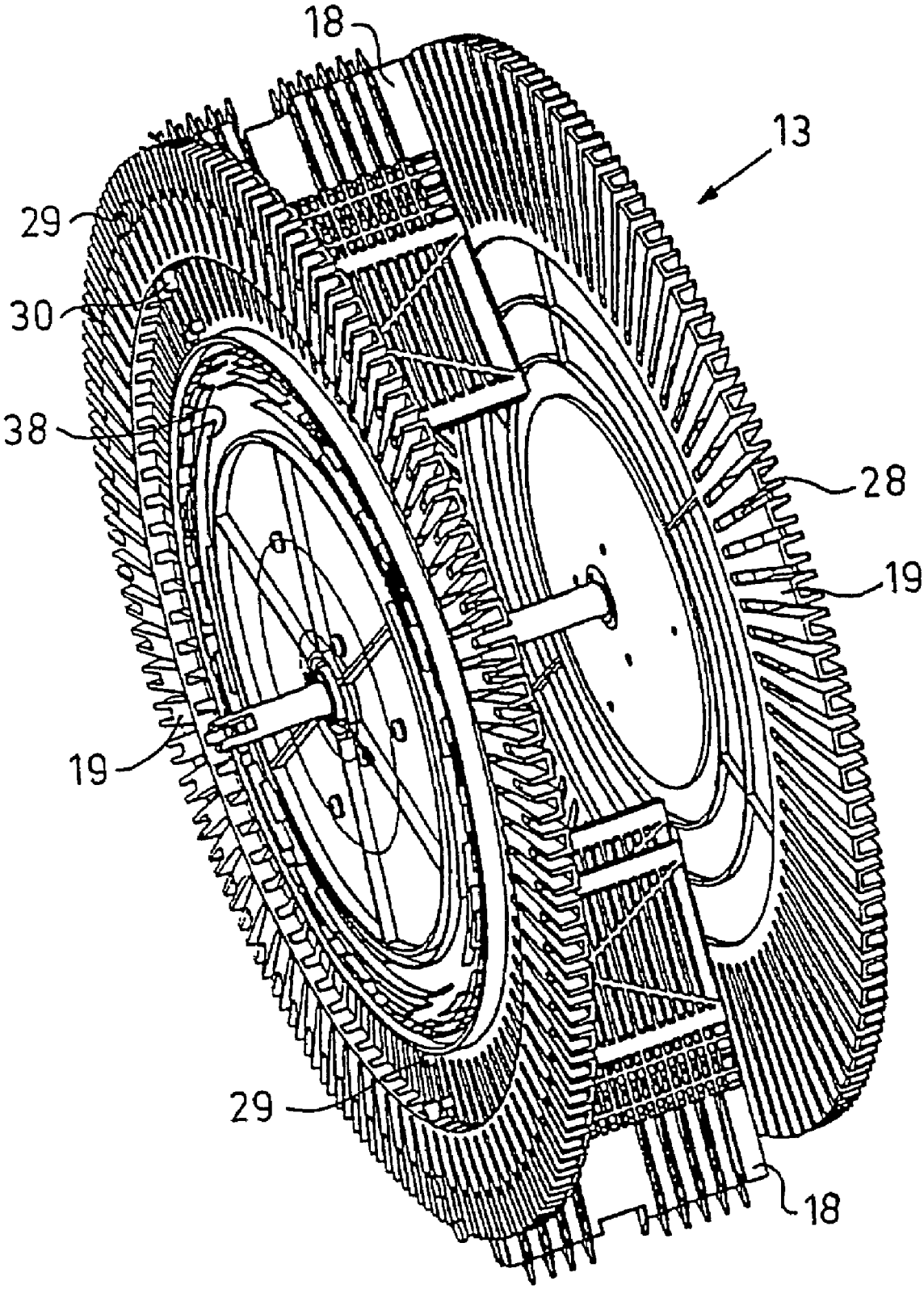
Figure 4:
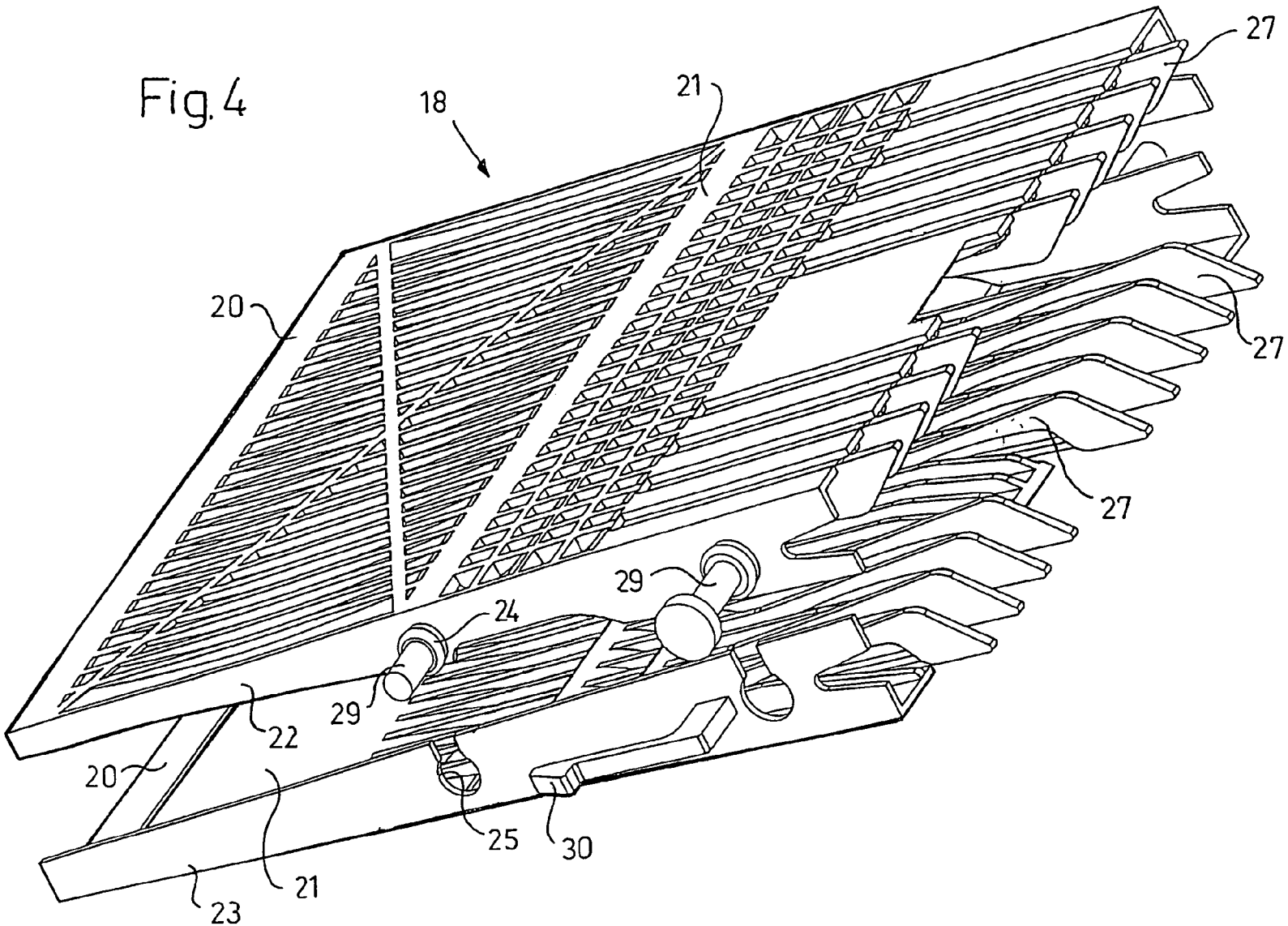
Figure 5:
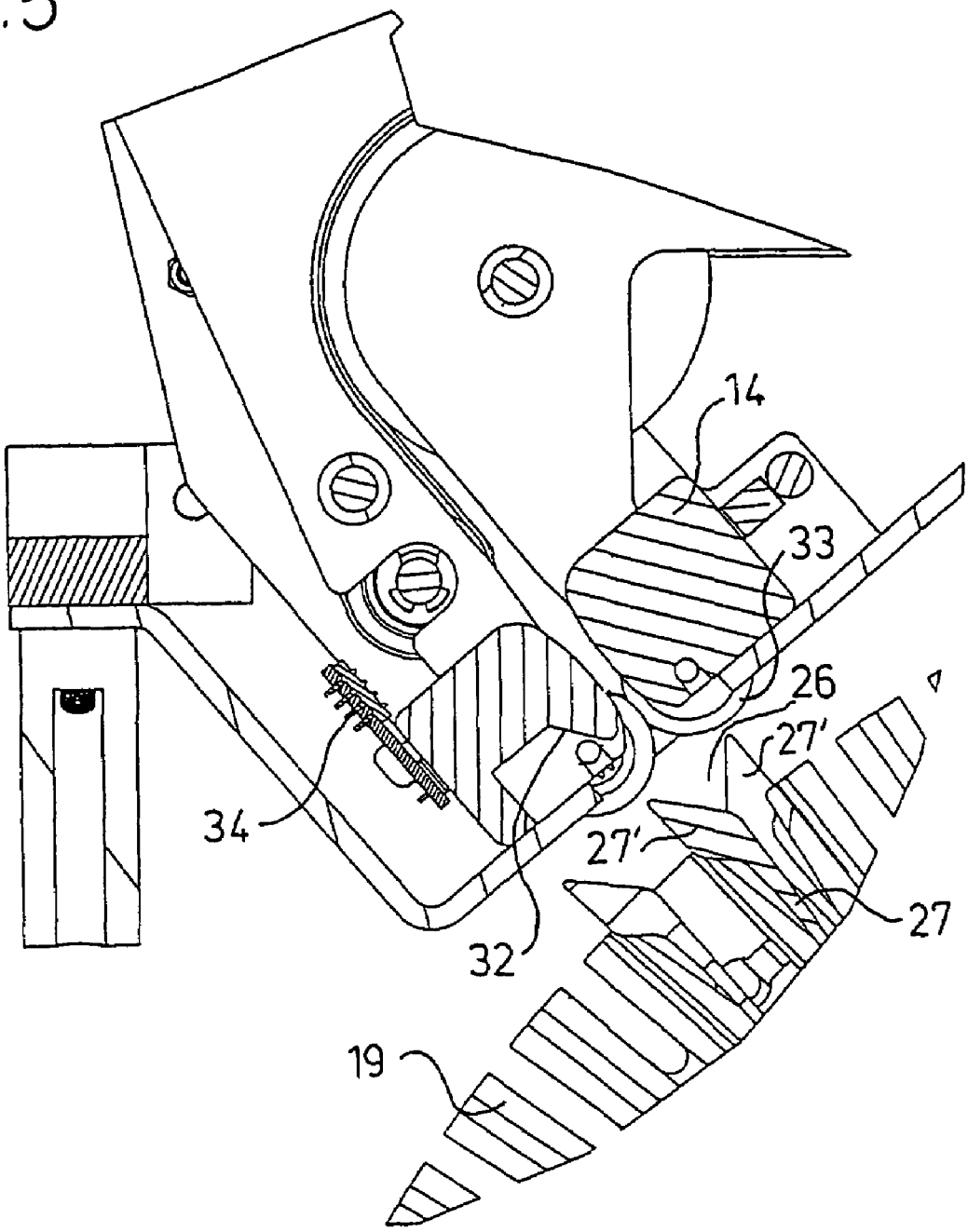
Figure 6:
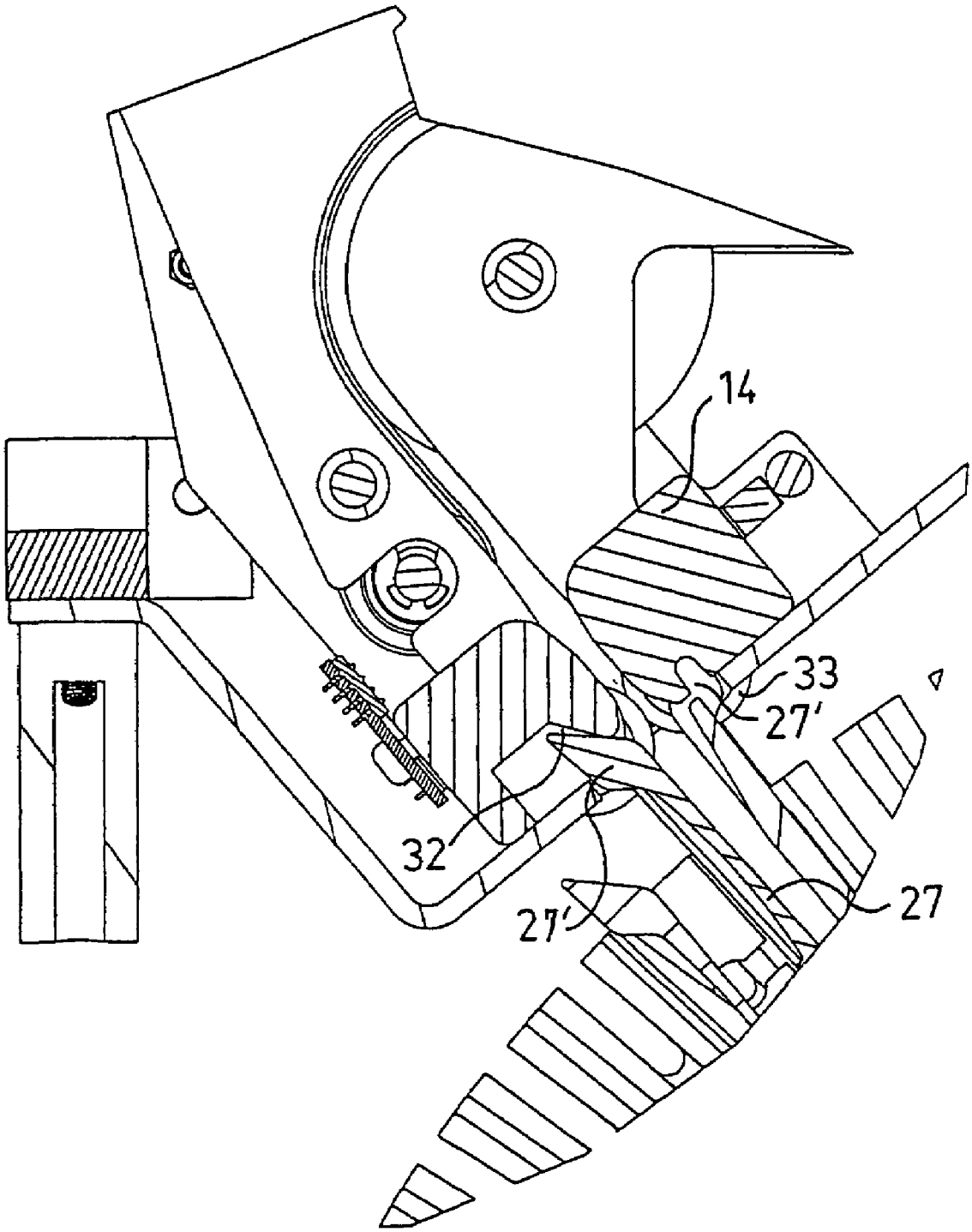

Below, the invention is described in further detail with reference to the accompanying drawings, in which:

FIG. 1 shows a partially exploded perspective view of an arrangement according to an embodiment of the invention selected by way of example only, FIG. 2 shows a side elevation, in section, of said arrangement, FIG. 3 shows a perspective view of a controllably rotatable magazine drum forming part of the arrangement, only some few of a large number of magazine pockets contained in said drum being shown, FIG. 4 shows an exploded perspective view of one of the magazine pockets, FIG. 5 is a partial view in section corresponding to FIG. 2 and on an enlarged scale, showing a magazine pocket, placed in front of an infeed station of the arrangement, in an inner end position, and FIG. 6 is a corresponding partial view, showing said magazine pocket in an outer end position.

The arrangement shown in the drawings constitutes a banknote handling arrangement, primarily intended to be used with a cash register in a shop or the like. However, it may be used also in other connections, for instance in a payment machine.

The arrangement comprises the following main components, namely a banknote receiving table 10, a banknote reader 11, a conveyor unit 12, a banknote magazine 13, a banknote infeed device 14 and a banknote outfeed device 15.

Magazine 13 consists of a generally cylindrical magazine drum which is controllably rotatable by means of an electric driving motor 16 and a cog-belt transmistion 17 and which contains a large number of sector-like magazine pockets 18, mounted for limited movement in a radial direction between two side pieces 19. As can best be seen from FIG. 4, each magazine pocket 18 is formed by two opposite members 20, each comprising a generally rectangular plate-like main portion 21 and two side flanges 22 and 23, extending along the longitudinal edges of said main portion. At said flanges, the two members 20 are provided with snap-in means 24 and 25, respectively, for holding said members together in positions in which they form a banknote receiving space therebetween.

At its radially outer end, each magazine pocket 18 has a combined infeed and outfeed opening 26, through which a banknote can be fed in into or fed out from the pocket. Furthermore, adjacent to opening 26, each pocket 18 is provided with holding means which act as resilient clamping means and serve to hold a banknote fed in into the pocket releasably within the same. These holding means are formed by a plurality of resiliently flexible fingers 27, provided on the main portion 21 of each member 20 and having clamping portions 27', located at or near opening 26 and movable relatively to each other between on the one hand clamping positions, in which they are arranged to bear resiliently against mutually opposite sides of a banknote fed in into pocket 18, and on the other hand release positions, in which they permit an unobstructed infeed of a banknote into or outfeed of a banknote from pocket 18 by means of feeding device 14. Fingers 27 are arranged in such a manner that, when uneffected and when any banknote has not been inserted into the pocket, the clamping portions 27' of the fingers of one member 20 may project a short length into the free spaces existing between the clamping portions of the fingers of the other member 20.

In order to permit a limited radial movement of magazine pockets 18, at their sides facing side pieces 19, the pockets are provided with guide pins 29 projecting into radially extending guide grooves 28 in the side pieces. Moreover, at its one end, each magazine pocket is provided with a resilient pawl 30 by means of which it normally can be held in an inner radially retracted position.

When a banknote is to be fed in into the above described arrangement, it is placed upon table 10, where-upon it is inserted into banknote reader 11. Upon a check of the validity of the banknote and a determination of the value of the banknote effected in said reader, the banknote is transferred by conveyor unit 12 to infeed device 14 which forms an infeed station located adjacent to the magazine and where the banknote can be fed in into a selectable unoccupied magazine pocket 18.

In order to bring about the infeed operation, after having been placed in front of infeed device 14, the selected magazine pocket 18 is actuated by means of an electrically powered operating device 31 which releases pawl 30 and through engagement with one of guide pins 29 moves the magazine pocket from its inner end position shown in FIG. 5 to a radially protruding outer end position shown in FIG. 6. During this movement of pocket 18, clamping portions 27' of fingers 27 are brought to engage cam means 32 of device 14 which move said clamping portions from their previous clamping positions to spaced-apart release positions.

By means of two controllably rotatable feeding rollers 33, which form part of infeed device 14 and which are arranged to bear against mutually opposite sides of a banknote inserted between said rollers, the banknote can then be inserted into pocket 18 without being hindered by clamping portions 27' of fingers 27. An electrooptical sensor 34 senses when the banknote has reached a predetermined position in which its rear end approaches rollers 33. When this happens, operating device 31 is caused to initiate a return movement of pocket 18. Simultaneously, the speed at which rollers 33 tend to feed the banknote is adapted to the speed at which pocket 18 moves in a radial direction into the magazine drum. Clamping portions 27' are then moved away from cam means 32 and brought into resilient contact with mutually opposite sides of the banknote in order then to hold the banknote in such a position in pocket 18 that the banknote will project from the pocket with a short rear portion thereof. When the pocket has been returned to its inner end position, the arrangement is ready to permit an insertion of another banknote therein.

The outfeed device 15 forms an outfeed station adjacent to magazine 13 where banknotes may be fed out from the magazine one by one.

When a selectable pocket 18 has been placed in front of outfeed device 15, an outfeed operation can be effected in a manner inverted in relation to the described infeed of a banknote at the infeed station. In order to facilitate a movement of a magazine pocket 18 placed in front of outfeed device 15 in a radial direction, there is provided an electrically powered operating device 35 which functions in the same manner as device 31. The outfeed device includes controllable feeding rollers 36 and an electrooptical sensor 37.

The arrangement also comprises a control and monitoring unit, not shown in the drawings, wherein information about the contents of the magazine is continuously stored as individual information about the contents of each individual magazine pocket. Information about the denomination of a banknote fed in into the magazine is supplied to said unit from banknote reader 11, while information about the identity of a magazine pocket at a given moment placed in front of infeed device 14 or outfeed device 15 is supplied to said unit from a sensor, not shown, cooperating with code means 38 of the magazine.

The invention is not restricted to the embodiment above described and shown in the drawings. Instead, many other embodiments are feasible within the scope of the invention as defined in the following claims. By way of example, it can be mentioned that the arrangement need not necessarily be provided with separate infeed and outfeed devices but may instead be provided with a combined infeed and outfeed device. Furthermore, it should be noted that the arrangement may be designed to handle other documents than banknotes. Finally, it could be mentioned that the magazine need not consist of a rotatable drum. Instead, it may for instance consist of an elongate magazine which is mounted for rectilinear movement in its longitudinal direction.

The invention claimed is:

1. An arrangement for handling banknotes and/or other documents, said arrangement comprising:

a magazine (13) containing a plurality of magazine pockets (18), each one of said pockets being arranged to receive only one banknote or other document therein and having, at one end thereof, a combined infeed and outfeed opening (26) through which a banknote or other document can be fed into or fed out from said pocket (18), and each one of said pockets being provided with holding means (27) for releasably holding, within said pocket, a banknote or other document fed into said pocket (18);

controllable driving means (16, 17) for the magazine (13), by means of which a selectable magazine pocket (18) can be placed with said opening (26) in front of a selected one of an infeed station (14) and an outfeed station (15) located adjacent to said magazine (13);

first feeding means (33) provided at the infeed station (14) for controllably feeding a banknote or other document from a pocket (18) placed in front of the infeed station (14);

second feeding means (36) provided at the outfeed station (15) for controllably feeding a banknote or other document from a pocket (18) placed in front of the outfeed station (15);

first cam means (32) provided at the infeed station (14); and second cam means (32) provided at the outfeed station (15), wherein:

said holding means of each said magazine pocket (18) comprise at least one pair of resiliently flexible clamping means having clamping portions (27') located at or near said opening (26) and movable relative to each other between, on the one hand, clamping positions in which said clamping portions are arranged to bear resiliently against mutually opposite sides of a banknote or other document fed into said pocket (18), and, on the other hand, release positions in which said clamping portions permit an unobstructed infeed of a banknote or other document into said pocket (18) by said first feeding means (33), or an unobstructed outfeed of a banknote or other document from said pocket (18) by said second feeding means (36); and said clamping portions (27') of a magazine pocket (18) placed in front of one of the stations (14, 15) are capable of being brought to engage a respective one of said cam means and to move from the clamping position to the release position through a limited relative displacement of said pocket (18) and the respective one of said cam means (32) in a direction towards each other.

2. Arrangement according to claim 1, wherein said first feeding means (33) comprise at least one first pair of controllably rotatable cylinders or rollers provided at the infeed station (14) and said second feeding means (36) comprise at least one second pair of controllably rotatable cylinders or rollers provided at the outfeed station (15), each said pair of controllably rotatable cylinders or rollers being arranged to bear against mutually opposite sides of a banknote or other document inserted therebetween.

3. Arrangement according to claim 1, wherein said cam means (32) are mounted in stationary positions, whereas each magazine pocket (18) is movably mounted in the magazine (13) for controllable limited movement thereof between, on the one hand a retracted inner end position, and on the other hand an outer end position, in which said magazine pocket protrudes from the rest of the magazine (13) and to which said magazine pocket can move temporarily when placed in (14, 15).

4. Arrangement according to claim 3, wherein the magazine consists of a rotatable magazine drum (13) containing a plurality of magazine pockets (18), each having a shape similar to a circular sector.

5. Arrangement according to claim 1, wherein said cam means (32) are mounted for limited movement thereof in direction towards the magazine (13), whereas the magazine pockets, (18) are stationarily mounted in the magazine (13).

6. Arrangement according to claim 5, wherein said magazine consists of a rotatable magazine drum (13) containing a plurality of magazine pockets (18), each having a shape similar to a circular sector.

7. Arrangement according to claim 1, wherein said arrangement further comprises a sensor (34) which, when a banknote or other document is fed in into a magazine pocket (18) placed in front of an infeed station (14) and having the clamping portions (27') thereof located in their release positions due to an engagement with said cam means (32), is arranged to sense when the rear end of the banknote or other document reaches a predetermined position and then cause an operating device (31) to initiate a relative movement of said pocket (18) and said cam means (32) in direction away from each other and simultaneously adapt the speed at which the feeding means (33) tend to feed said banknote or other document to the speed of said relative movement of said pocket (18) and said cam means (32) in direction away from each other.

* * * * *

UNITED STATES PATENT AND TRADEMARK OFFICE

CERTIFICATE OF CORRECTION

PATENT NO. : 7,407,157 B2
APPLICATION NO. : 10/526188
DATED : August 5, 2008
INVENTOR(S) : Gustaf Lars-Åke Hansson et al.

It is certified that error appears in the above-identified patent and that said Letters Patent is hereby corrected as shown below:

Title Page, Item (73) Assignee, correct the incorrect assignee name by deleting "GUNNEBO SAFE PAY AB", and insert --GUNNEBO CASH AUTOMATION AB--.

Signed and Sealed this
Twelfth Day of July, 2011

David J. Kappos

David J. Kappos
*Director of the United States Patent and Trademark Office*